US012760939B2

(12) United States Patent
Kaprekar

(10) Patent No.: US 12,760,939 B2
(45) Date of Patent: Oct. 13, 2026

(54) SYSTEM AND A METHOD FOR GEOTHERMAL HEATING AND COOLING BASED ON ADVECTION

(71) Applicant: GENESYS US LLC, Chicago, IL (US)

(72) Inventor: Mandar Shridhar Kaprekar, Thane West (IN)

(73) Assignee: Genesys US LLC, Chicago, IL (US)

( * ) Notice: Subject to any disclaimer, the term of this patent is extended or adjusted under 35 U.S.C. 154(b) by 0 days.

(21) Appl. No.: 18/245,166

(22) PCT Filed: Nov. 25, 2022

(86) PCT No.: PCT/IN2022/051032

§ 371 (c)(1),
(2) Date: Mar. 14, 2023

(87) PCT Pub. No.: WO2023/095172

PCT Pub. Date: Jun. 1, 2023

(65) Prior Publication Data

US 2024/0328677 A1 Oct. 3, 2024

(30) Foreign Application Priority Data

Nov. 25, 2021 (IN) ..... 202121054521

(51) Int. Cl.
*F24T 10/30* (2018.01)
*F24T 10/00* (2018.01)
(Continued)

(52) U.S. Cl.
CPC ..... *F24T 10/30* (2018.05); *F24T 10/17* (2018.05); *F24T 10/20* (2018.05); *F24T 50/00* (2018.05);
(Continued)

(58) Field of Classification Search
CPC . F24T 10/30; F24T 10/17; F24T 10/20; F24T 50/00; F24T 2010/50; F24T 2010/56; F28D 20/0052; F24V 50/00; Y02E 10/10
See application file for complete search history.

(56) References Cited

U.S. PATENT DOCUMENTS 3,874,174 A 4/1975 Greene
3,965,972 A 6/1976 Petersen
(Continued)

FOREIGN PATENT DOCUMENTS

CN 106482265 A 3/2017
KR 100771934 B1 * 10/2007 ..... F25B 30/06
(Continued)

OTHER PUBLICATIONS

KR 101514673 B1 Translation (Year: 2015).*
(Continued)

*Primary Examiner* — Jerry-Daryl Fletcher
*Assistant Examiner* — Dario Antonio Deleon
(74) *Attorney, Agent, or Firm* — Ballard Spahr LLP

(57) ABSTRACT

An advection based geothermal system is disclosed herein. The system comprises plurality of supply wells 200 situated below the ground level (GL); plurality of geothermal apparatus 300 within each of the supply wells 200; at least one diffusion well 600 for discharge of water received from the enclosure 1300; at least one auxiliary cooling apparatus 2100 within the enclosure 1300; and plurality of heat pumps 1100 connected to the geothermal apparatus 300 & the auxiliary cooling apparatus 2100 to provide cooling & heating within the enclosure 1300.

20 Claims, 15 Drawing Sheets

(51) Int. Cl.

| | |
|---|---|
| ***F24T 10/17*** | (2018.01) |
| ***F24T 10/20*** | (2018.01) |
| ***F24T 50/00*** | (2018.01) |
| ***F28D 20/00*** | (2006.01) |

(52) U.S. Cl.
CPC ..... *F28D 20/0052* (2013.01); *F24T 2010/50* (2018.05)

(56) References Cited

U.S. PATENT DOCUMENTS

| | | | |
|---|---|---|---|
| 4,077,220 | A | 3/1978 | Matthews |
| 4,344,414 | A | 8/1982 | Balch |
| 4,375,831 | A | 3/1983 | Downing, Jr. |
| 4,388,807 | A | 6/1983 | Matthews |
| 4,426,849 | A | 1/1984 | Matthews |
| 4,776,169 | A | 10/1988 | Coles, Jr. |
| 5,024,553 | A | 6/1991 | Katsuragi |
| 5,058,386 | A | 10/1991 | Senanayake |
| 5,178,485 | A | 1/1993 | Katsuragi |
| 5,183,100 | A | 2/1993 | Harrell, Jr. |
| 6,073,448 | A | 6/2000 | Lozada |
| 6,142,215 | A | 11/2000 | Paulsen |
| 8,434,554 | B2 | 5/2013 | Viernickel |
| 8,672,024 | B2 | 3/2014 | Tyler |
| 10,962,261 | B1 | 3/2021 | Hill |
| 12,422,169 | B2 | 9/2025 | Randolph |
| 2011/0100586 | A1 | 5/2011 | Yang |
| 2012/0090807 | A1* | 4/2012 | Stewart et al. ..... F03G 7/04 165/45 |
| 2013/0283839 | A1 | 10/2013 | Genung |
| 2013/0299123 | A1* | 11/2013 | Matula ..... F24F 5/005 165/45 |
| 2013/0333859 | A1 | 12/2013 | Genung |
| 2018/0209694 | A1 | 7/2018 | Gordon |
| 2022/0228760 | A1* | 7/2022 | Parrella et al. ..... F24T 10/17 |
| 2024/0240875 | A1* | 7/2024 | Larsson et al. ..... F24T 10/30 |

FOREIGN PATENT DOCUMENTS

| | | | | |
|---|---|---|---|---|
| KR | 101514673 | B1 * | 4/2015 | ..... F25B 30/00 |
| NL | 1008209 | C2 | 8/1999 | |
| NL | 1014146 | C2 | 7/2001 | |
| RU | 2341736 | C2 * | 12/2008 | ..... F24T 10/30 |
| RU | 2756624 | C1 | 10/2021 | |
| WO | WO 2020/117946 | | 6/2020 | |

OTHER PUBLICATIONS

RU 2341736 C2 Translation (Year: 2008).*
KR 100771934 B1 Translation (Year: 2007).*
International Search Report an Written Opinion for corresponding PCT Application No. PCT/IN2022/051032, dated Jun. 12, 2022.
International Preliminary Report on Patentability for corresponding PCT Application No. PCT/IN2022/051032, dated Jan. 3, 2023.
Search Opinion for corresponding EP Application No. EP 22 89 8133, dated Sep. 24, 2025.

* cited by examiner

SYSTEM AND A METHOD FOR GEOTHERMAL HEATING AND COOLING BASED ON ADVECTION

CROSS-REFERENCE TO RELATED APPLICATION

This application claims priority from a Patent application filed in India having Patent Application No. 2021/21054521, filed on Nov. 25, 2021, and titled "A SYSTEM AND A METHOD FOR GEOTHERMAL HEATING AND COOLING BASED ON ADVECTION" and a PCT Application No. PCT/IN2022/051032 filed on Nov. 25, 2022, and titled "A SYSTEM AND A METHOD FOR GEOTHERMAL HEATING AND COOLING BASED ON ADVECTION."

FIELD OF INVENTION

The present invention generally relates to regulating temperature within an enclosure, such as a house, a building or such. The present invention particularly relates to a device and a system to provide heating or cooling to the enclosure using geothermal energy.

BACKGROUND & PRIOR ARTS

Geothermal energy may be defined as a form of heat energy which originates from sub-surface of the earth, which may be utilized for heating and cooling applications. In general, geothermal energy systems utilize consistent subsurface temperature of the earth as a heat source in winter and as a heat sink in summer.

Having stated of systems employing geothermal energy, it generally means that such systems use subsurface rocks & sediments for heat exchange. However, WO2020117946 deals with a system which takes advantage of flowing or stationary water by having ground loops. The said system includes a groundwater heat exchanger within a borehole and exposed to a groundwater flow within an aquifer. An output pipe is provided to deliver the ground loop flow to the main heat exchanger through the groundwater heat exchanger.

The geothermal energy systems, that use heat energy associated with flowing or stationary water, is generally classified into open loop geothermal system and closed loop geothermal system. The open loop geothermal system may use ground water for transferring heat. The closed loop geothermal system may use a mix of antifreeze and water, which is made to cycle through pipes buried underground, instead of using the groundwater to transfer heat as in the case of open loop system. In both the systems, the pipes carrying water (along with the mix as the case may be) are eventually connected to the heat pump to achieve the desired effect in the give enclosure.

Even though the geothermal energy systems enable the heating and cooling applications, there exists a plurality of challenges associated with the geothermal energy systems. The closed loop geothermal system requires significantly large area for implementation, along with long pay back periods. Additionally, the closed loop geothermal systems has an associated piping loop which is buried underground. The nature of the closed loop system imposes limitations on the overall efficiency of the system. The efficiency of the closed loop geothermal systems may be related to various factors such as thermal conductivity of piping loop material, grout material, and ground strata. Poor thermal conductivity of the piping loop and requirement of a significant heat transfer area are also a matter of concern.

On the other hand, the open loop systems have their own limitations. Though open loop systems show better efficiency compared to the closed loop systems, contamination due to bacteria remains one of the major concerns. Some areas on the globe have scarce amount of water, which does affect the functionality of the open loop system. Furthermore, the extraction of the ground water above ground level is legally not permissible in some of the regions, which makes the open loop geothermal system inviable.

It may be noted that the geothermal systems are adopted in less than 1% cases due to high cost involved, large amounts of land requirement as well as issues of contamination due to bacteria. Hence, there is a need for an improved system and a method for geothermal heating and cooling based on advection to address the aforementioned issues.

SUMMARY OF INVENTION

It is an object of the invention to regulate the temperature within an enclosure as per the need.

It is a primary object of the invention to provide heating as well as cooling within the enclosure by the use of geothermal energy.

It is a further objective of the invention to provide temperature regulation geothermally in the enclosure that involves less space.

Accordingly, the present invention discloses advection based geothermal system adapted to provide cooling and heating within an enclosure.

The said system comprises plurality of supply wells adapted to draw groundwater for storage; plurality of geothermal apparatus within the supply wells configured to use geothermal energy the stored water; at least one diffusion well provided parallel to & lower than the supply wells configured to store discharged water; at least one auxiliary cooling apparatus within the enclosure to supplement the geothermal apparatus; and plurality of heat pumps connected to the geothermal apparatus & the auxiliary cooling apparatus.

In an embodiment, each of the said supply wells is configured to draw groundwater via a supply mechanism and an intake mechanism.

In an embodiment, each of said supply wells include a geothermal apparatus that assists advection based geothermal system for cooling or heating of the enclosure by means of the geothermal energy. The said apparatus comprises a heat exchangers unit adapted to receive a groundwater pipe and closed loop inlet & outlet pipes from & to an enclosure; a groundwater pumps unit connected in series with the heat exchangers unit by means of an inlet pipe; and a filtration unit around the groundwater pumps unit.

In an embodiment, the said apparatus is held to a position in the supply wells by means of a holding device. The said holding device has at least one fixed sling attached to one end of a pump sling holder by means of a fixed sling hook. The said holding device further includes at least one liftable sling attached to another end of the pump sling holder by means of a liftable sling hook.

In an embodiment, a pitless adapter unit is further provided for interconnecting the closed loop inlet & outlet pipes and the groundwater pipings. The said pitless adapter unit comprises; a first female fitting adapted to receive the closed loop inlet & outlet pipes; a second female fitting adapted to receive the groundwater piping, a first male fitting adapted to house the female fitting and a second male fitting adapted to house a drop pipe.

In an embodiment, the system is further provided with an installer device to assist in installing the geothermal apparatus. The installer device is included with a means to install the geothermal apparatus within the supply well. The installer device includes a clean-in-place unit and an antifreeze recovery unit.

The present invention alternately discloses advection based geothermal system adapted to provide cooling and heating within an enclosure, wherein the said system comprises of plurality of supply wells; plurality of geothermal apparatus within the supply wells; at least one diffusion well provided parallel to & lower than the supply wells; plurality of subsurface units situated placed outside the supply wells, wherein each of the subsurface unit is coupled to the geothermal apparatus, closed loop inlet & outlet pipes, and the diffusion well; at least one auxiliary cooling apparatus within the enclosure; and plurality of heat pumps connected to the geothermal apparatus & the auxiliary cooling apparatus.

In yet another embodiment, the present invention discloses an advection based movable geothermal system, which is configured to be used when there is an availability of surface water body, such as pond, lake etc. The said system comprises of a cannon unit, an inline valve box, and a trench bundle. The cannon unit is provided with at least one pair of wheels enabling to move in or out of the surface water.

BRIEF DESCRIPTION OF DRAWINGS

Following figures illustrate at least one preferred embodiment of the invention and various components associates with it.

FIG. 4(*b*) illustrates a pitless adapter unit 220.

DETAILED DESCRIPTION OF THE INVENTION

Figure 1:
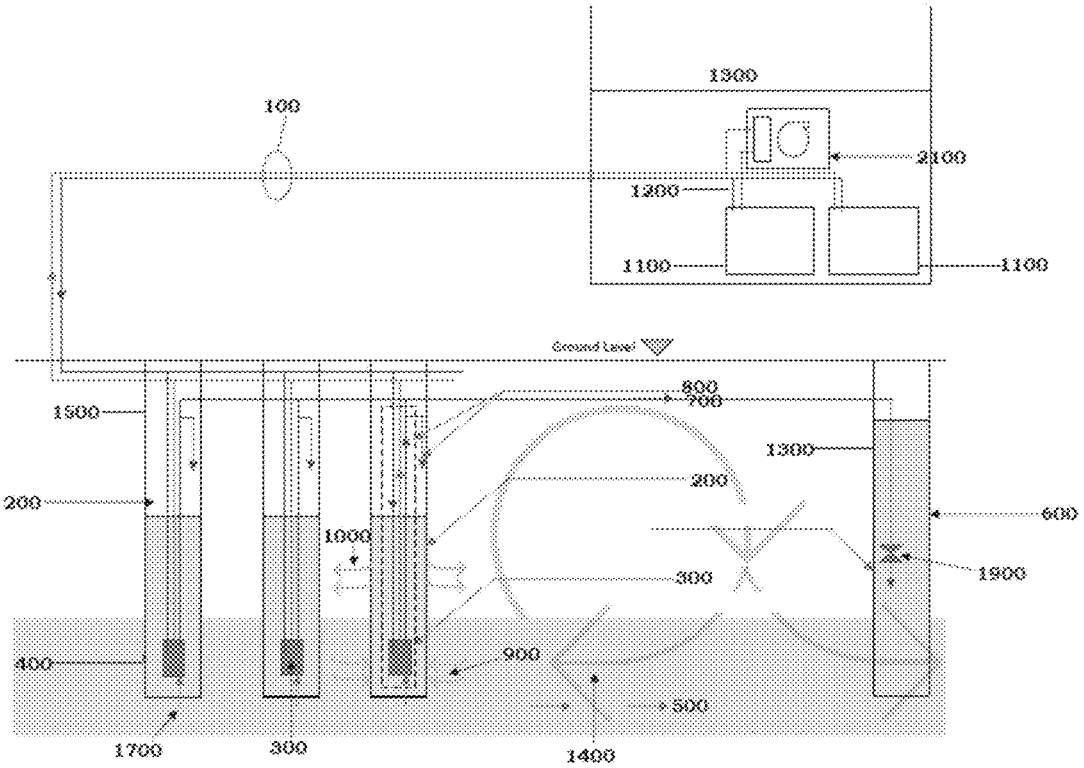
FIG. 1 illustrates a schematic representation of the advection based geothermal system.
Figure 1A:
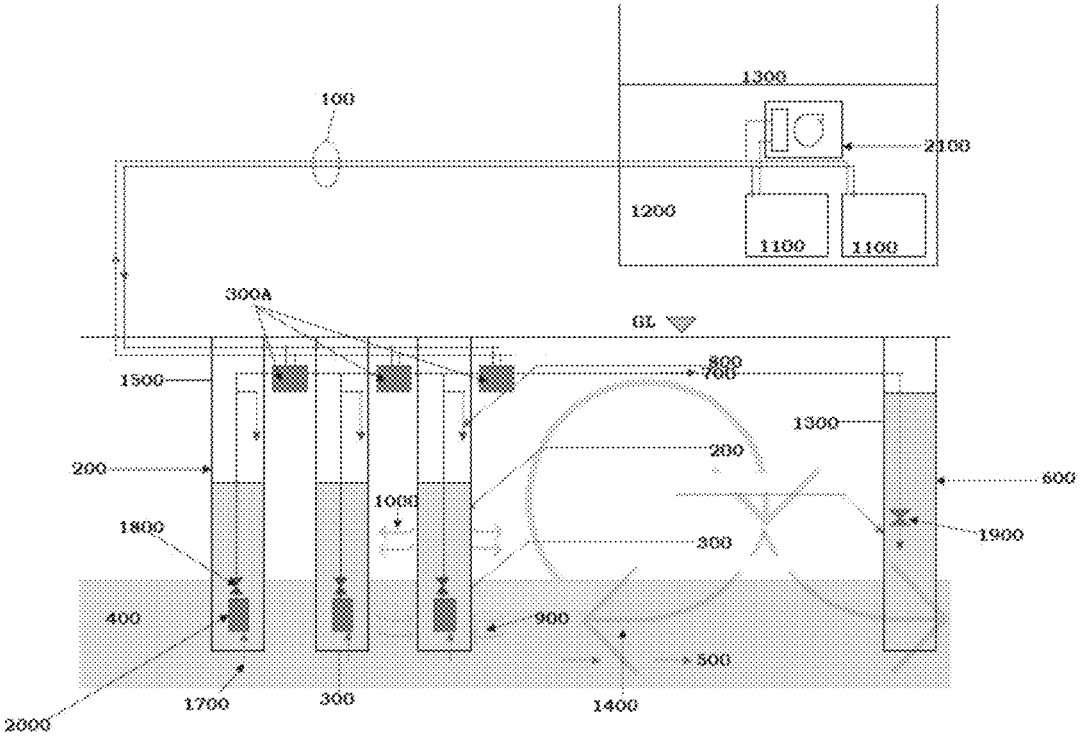
FIG. 1A illustrates a schematic representation of the system as an alternate embodiment.

Accordingly, the present invention discloses an advection based geothermal system, wherein the said system is adapted to provide cooling and heating within an enclosure using geothermal energy. As a consequence, the system will prove to be power saving in terms of electric energy. The system does not do away with use of electricity but reduces its use due to its unique working.

The present invention further discloses a geothermal apparatus to assist advection based geothermal system.

The present invention further discloses a holding device to hold an apparatus inside a supply well of the advection based geothermal system.

The present invention further discloses a pitless adapter unit configured to connect the groundwater piping as well as the closed loop inlet & outlet pipes in an advection based geothermal system.

The present invention even further discloses an installer device for assisting in installing a geothermal apparatus.

The invention is described herein in detail with the help of figures appended at the end of the specification. The figures illustrate the preferred embodiment as well as other embodiments that define the scope of the present invention. However, it may be understood that the figures presented herein are intended to exemplify the scope of the invention only. The person skilled in art may note that by no means the figures limit the scope of the invention. Any variation in the drawings by any other person will be falling in the scope of the present invention.

FIG. 1 illustrates a schematic representation of the advection based geothermal system. The system comprises plurality of supply wells 200 situated below the ground level (GL) and adapted to receive groundwater source 400; plurality of geothermal apparatus 300, each provided within each of the supply wells 200, adapted to exchange heat between the enclosure 1300 & the groundwater source 400; at least one diffusion well 600 provided parallel to & lower than the supply wells 200 for discharge of water received from the enclosure 1300; at least one auxiliary cooling apparatus 2100 within the enclosure 1300 adapted to receive groundwater from the geothermal apparatus 300 and precool return air from the enclosure 1300 to plurality of heat pumps 1100; and plurality of heat pumps 1100 connected to the geothermal apparatus 300 & the auxiliary cooling apparatus 2100 to provide cooling & heating within the enclosure 1300.

The system provides heating or cooling effect to the enclosure by use of the groundwater sources, such as any aquifer. The supply well 200 takes in the groundwater from the aquifer and pushes the groundwater through the geothermal apparatus. The groundwater exchanges heat with the closed loop connected to the other side of the geothermal apparatus. After exchanging heat, the groundwater is transported to the diffusion well 600, where the water is diffused back to the aquifer.

In the context of the present invention, the term "enclosure" means any closed space which is to be provided with a heat or cold as per the requirement. Such closed space may be a room, a house or a building, utilised for commercial or residential purposes. There is no limit to the area of the "enclosure". The present invention is adapted to provide heating or cooling effect to the enclosure, irrespective of its area, with tweaking in system's dimensions as per the requirement.

In a preferred embodiment, each of the supply wells 200 is configured to draw groundwater via a supply mechanism 1700 & an intake mechanism 900. In an embodiment, the supply wells 200 are placed either in sequential manner or in parallel. In a working embodiment, the supply mechanism 1700 and an intake mechanism 900 may be a combination of the pumps by which groundwater may be drawn into the supply wells 200. Further, the arrangement of the plurality of supply wells 200 depends upon the system requirement, which includes factors such as load. In a preferred embodiment, the discharge well 600 is provided with a cracking pressure valve 1900, which ensures that there is no air intake inside the diffusion loop, eliminating the possibility of the bacteria growth in the system.

Figure 6:
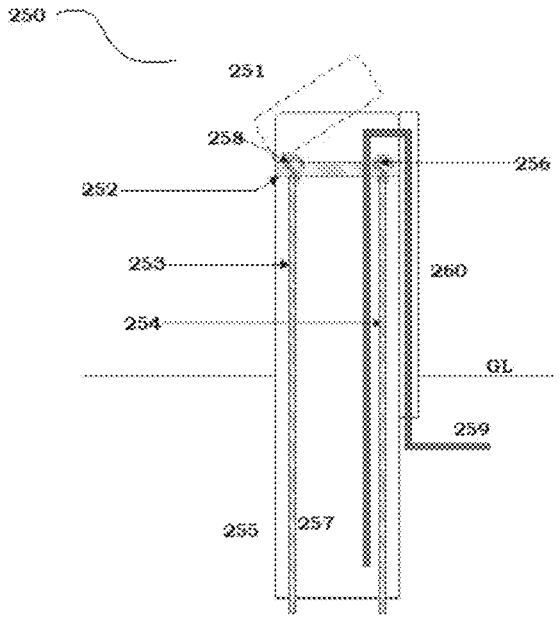
FIG. 6 illustrates a holding device 250 for holding the geothermal apparatus 300 inside the supply well 200.
Figure 8:
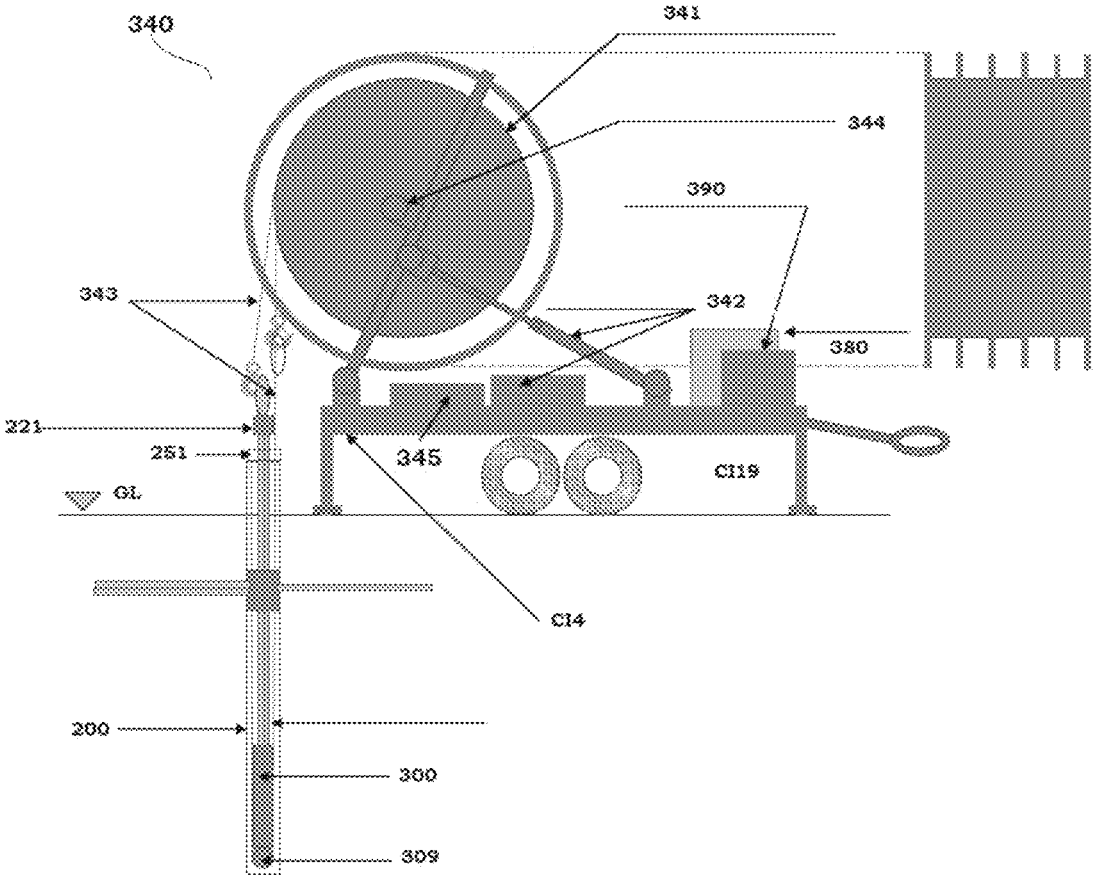
FIG. 8 illustrates an installer device 340 to install the geothermal apparatus 300 inside the supply well 200.

As stated before, each of the supply well 200 includes at least one geothermal apparatus 300, wherein the geothermal apparatus 300 is held into the supply well 200 by means of a holding device 250 FIG. 6. Further, the geothermal apparatus 300 is installed in the supply wells 200 by means of an installer device 340 (FIG. 8).

Figure 2:
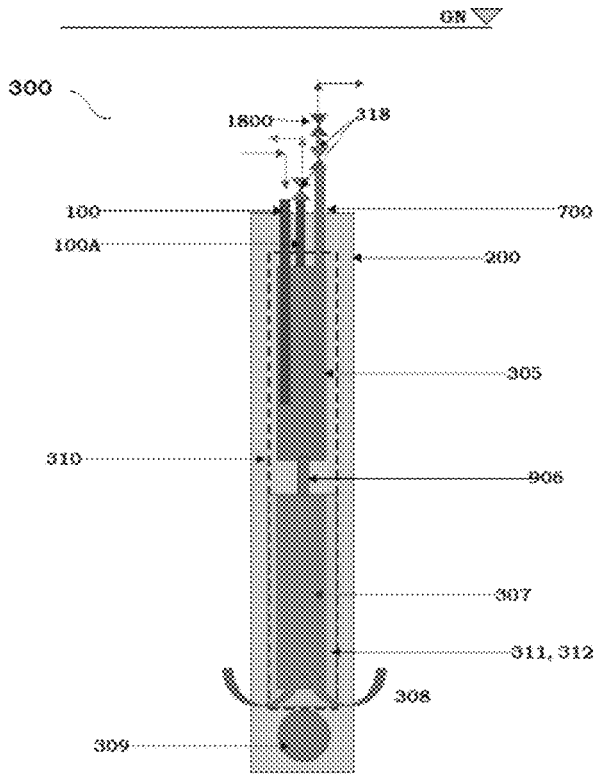
FIG. 2 illustrates a geothermal apparatus 300 which is a part of the system illustrated in FIG. 1.
Figure 3:
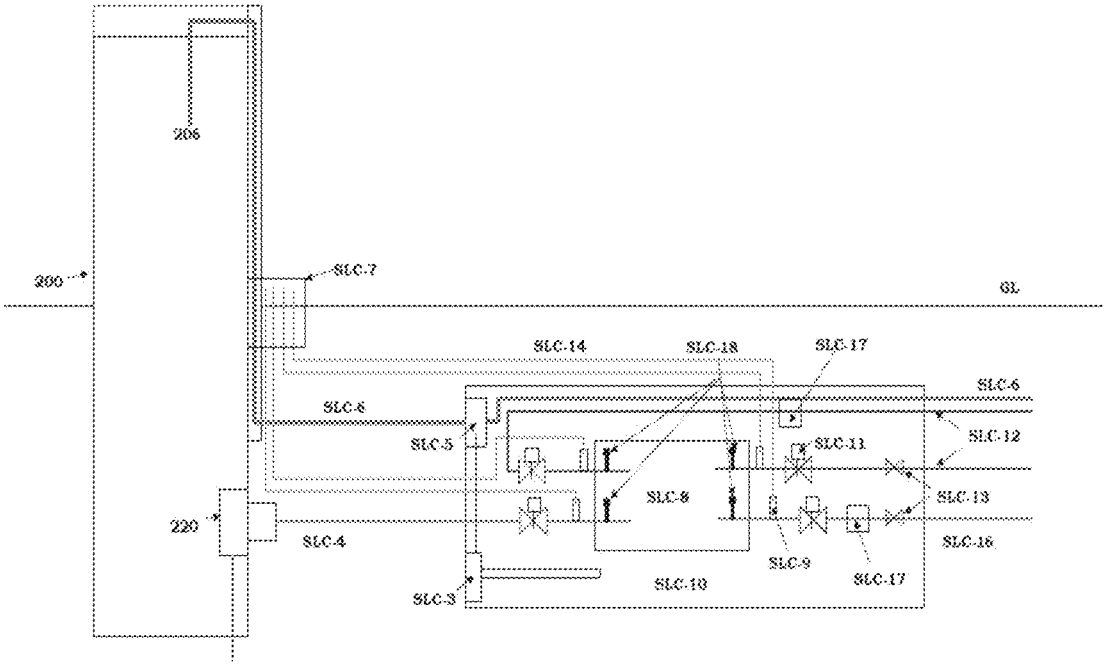
FIG. 3 illustrates a configuration connecting the supply wells 200.

FIG. 2 represents the geothermal apparatus 300, which is configured to assist the advection based geothermal system. The geothermal apparatus 300 comprises of a heat exchangers unit 305 adapted to receive a groundwater pipe 700 & closed loop inlet & outlet pipes 100 from & to an enclosure and towards a diffusion well 600; a groundwater pumps unit 307 connected in series with the heat exchangers unit 305 by means of an inlet pipe 306; and a filtration unit 316 around the groundwater pumps unit 307.

The geothermal apparatus 300 plays a crucial part in the working of the present system. The heat exchanger unit 305 includes a plurality of heat exchangers stacked together to meet the system requirement. The plurality of heat exchangers tend to enhance the capacity of the system to heat or cool the enclosure. The heat exchanger unit 305 utilise the thermal energy of the water received in the supply wells 200 for providing heat or cold to the enclosure 1300 through the closed loop inlet pipes from & to the enclosure 1300. Further, the water received through the closed loop outlet pipes by the geothermal apparatus 300 is discharged in the diffusion well 600.

Within the apparatus, the heat exchangers unit 305 and the groundwater pumps unit 307 are encased in a covering 310. Further, a pair of constant flow valves 318 is provided for water flow regulation towards the groundwater pipe 700 and the closed loop inlet & outlet pipes 100.

Figure 7:
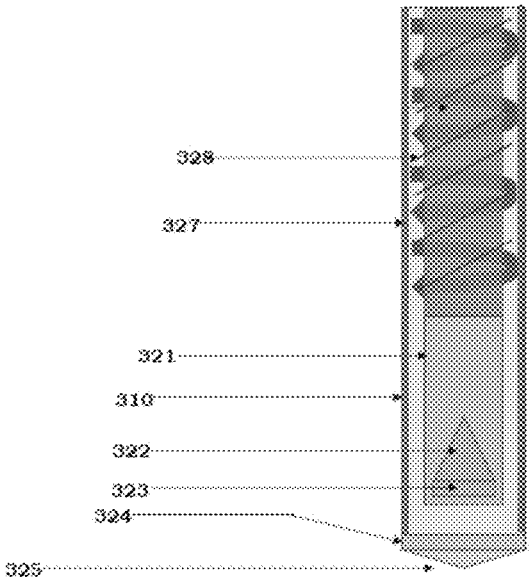
FIG. 7 illustrates a filtration unit 316 provided for the geothermal apparatus 300.

The filtration unit 316, configured to reduce possibility of contamination of stored water, provided in the geothermal apparatus 300 is illustrated in FIG. 7. Accordingly, the filtration unit 316 comprises of plurality of sieves 327 & slots 328 provided at the middle portion of the apparatus 300; a suction tube 321 below said plurality of sieves 327 & slots 328; a slider cone 322 below the suction tube 321; a suction gate plate 323 below the slider cone 322; a collector 324 below the suction gate plate 323; and an aperture 325 below the collector 324.

FIG. 6 illustrates the holding device 250 adapted to hold the geothermal apparatus 300 in the supply well 200. The holding device comprises a well cap 251 at a top end of the holding device 250; at least one pump sling holder 252; at least one fixed sling 253 attached to one end of the pump sling holder 252 by means of a fixed sling hook 258; and at least one liftable sling 254 attached to another end of the pump sling holder 252 by means of a liftable sling hook 256.

Figure 4A:
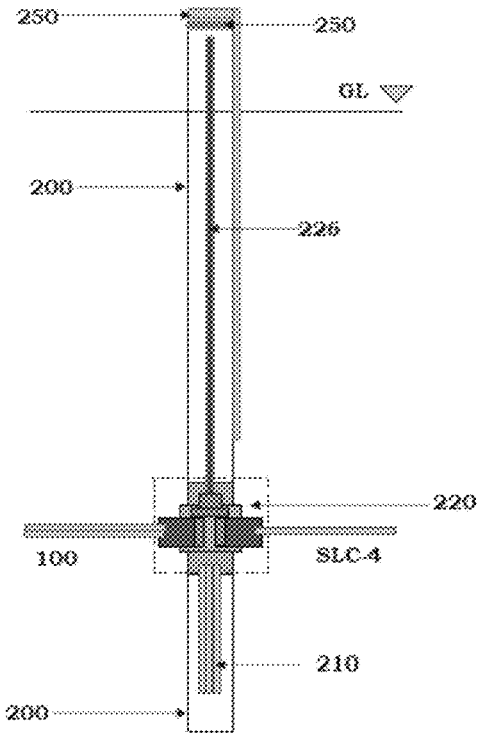
FIG. 4(*a*) illustrates a pitless adapter apparatus PAU10.
Figure 4B:
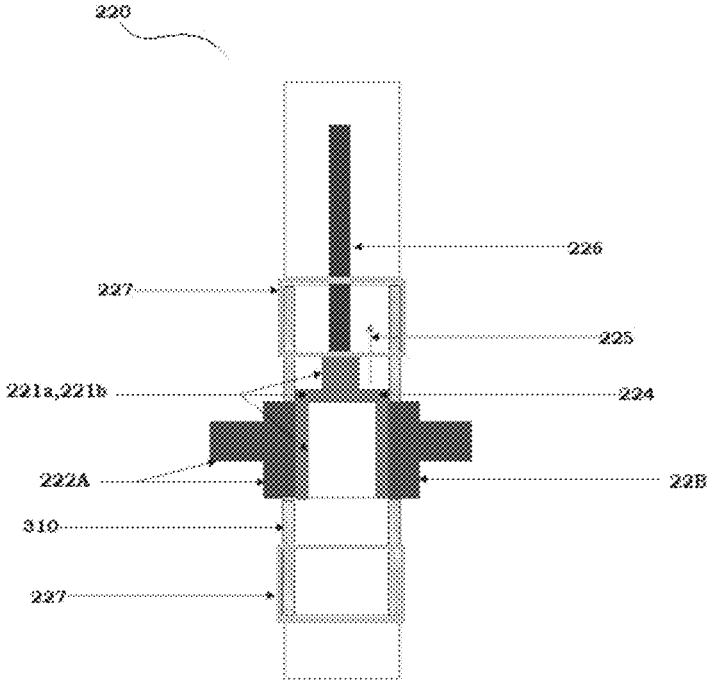

FIG. 4*a* illustrates the position of the pitless adapter unit 220 in the supply well 200, whereas FIG. 4*b* illustrates the composition of the pitless adapter unit 220. The pitless adapter unit 220 is configured to connect the groundwater piping 700 as well as the closed loop inlet & outlet pipes 100 and comprises of a first female fitting 222-A adapted to receive the closed loop inlet & outlet pipes 100; a second female fitting 222-B adapted to receive the groundwater piping 700; a first male fitting 221*a* adapted to house the female fitting 222A and a second male fitting adapted to house a drop pipe 226.

Figure 5:
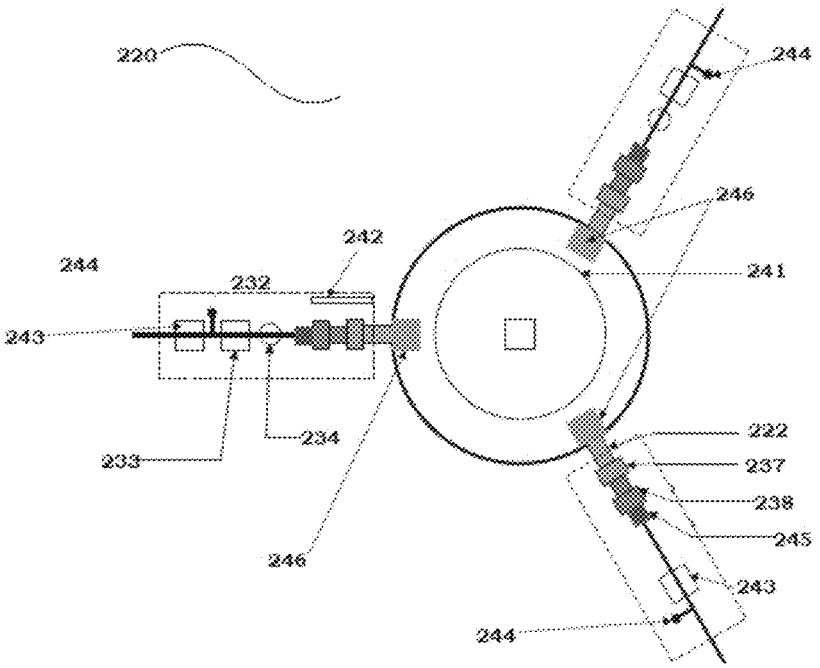
FIG. 5 illustrates a sectional view of the pitless adapter unit 220.

As shown in FIG. 5, each of the female fitting 222-A, 222-B comprises at least one union joint 237, at least one expander fitting 238, and at least one barb fitting 245. Each of the female fitting 222-A, 222-B further comprises of at least one flow meter 243, and at least one temperature sensor 244. The pitless adapter unit 220 is further provided with a port 234 for assisting recovery of anti-freeze composition.

The installer device 340 configured to assist in installing the geothermal apparatus 300 in the supply wells 200 in illustrated in FIG. 8. The installer device 340 for assisting in installing a geothermal apparatus 300 comprises: a spool 341 for winding cables, slings and such; at least one spool mover 342; plurality of slings 343; a power supply unit 345; a clean-in-place unit 380; and an anti-freeze recovery unit 390.

Figure 9:
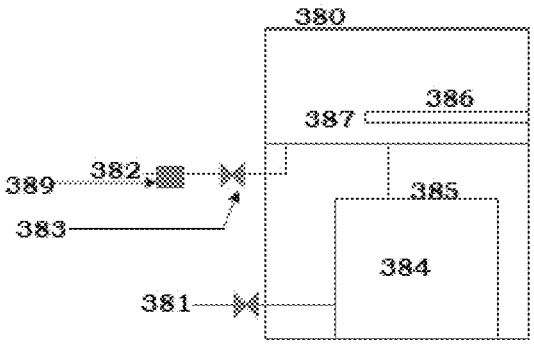
FIG. 9 illustrates a clean-in-place unit 380.

FIG. 9 illustrates the clean-in-place unit 380 configured to clean interiors of the installer device 340. The clean-in-place unit 380 comprises a cleaning fluid storage tank 386; a recirculatory pump 384; a CIP filter 389 coupled to the cleaning fluid storage tank 386 through an isolation valve 383.

Figure 10:
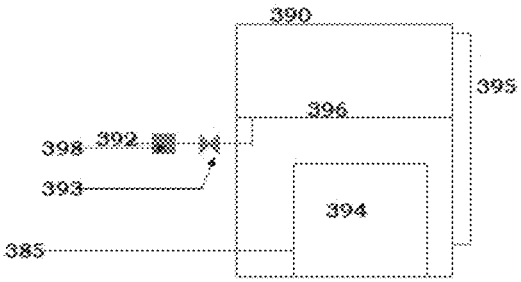
FIG. 10 illustrates an antifreeze recovery unit 390.

The antifreeze recovery unit 390 is configured to collect the expanding antifreeze composition, and to recycle back in the system once the composition loses adequate heat. Such antifreeze composition act as a coolant while providing cooling effect in the system. As shown in FIG. 10, the antifreeze recovery unit 390 comprises an antifreeze composition storage tank 396; a recovery pump 394; a recovery filter 398 coupled to the antifreeze composition storage tank 396 through an isolation valve 393.

Figure 11:
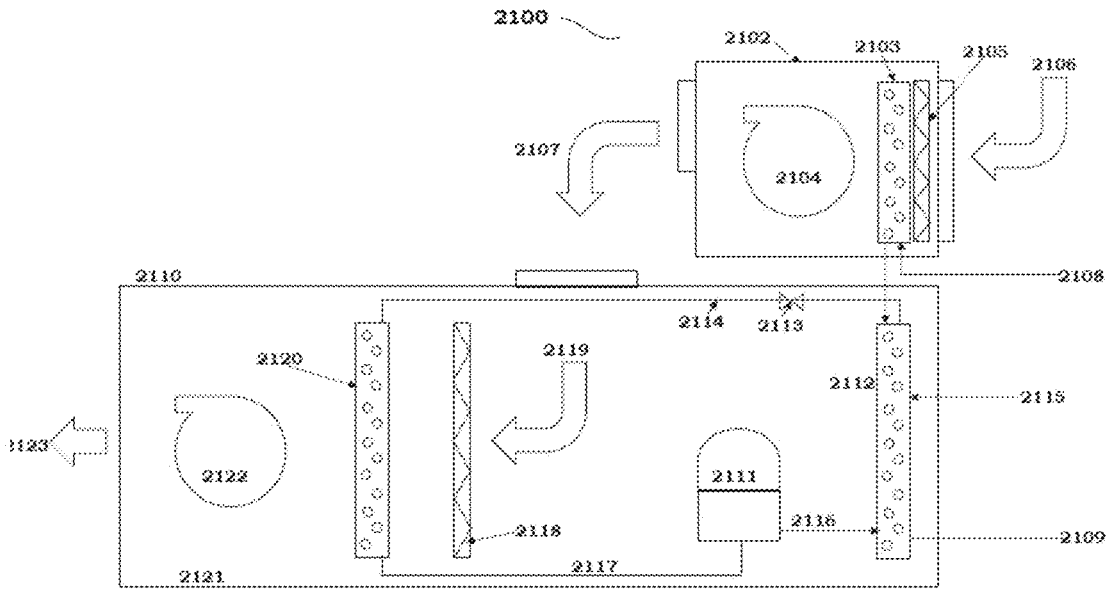
FIG. 11 illustrates an auxiliary cooling apparatus 2100 support the geothermal apparatus 300.

FIG. 11 illustrates the auxiliary cooling unit 2100 communicatively coupled with the heat pumps 1100. The auxiliary cooling unit 2100 inhales the return air 2106 from the enclosure 1300 that passes through an air filter 2105, and the auxiliary heat exchanger 2103 configured to cool this air. The rotating fan 2104 circulates and exhales the pre-cooled air towards the heat pump 1100 that cools down the air further.

In an alternate embodiment, the system comprises plurality of supply wells 200 below the ground level (GL) adapted to receive groundwater source 400; at least one pump 2000 provided in each of the supply wells 200; at least one diffusion well 600 provided parallel to & lower than the supply wells 200 for a discharge of the water received from the enclosure 1300; plurality of subsurface unit 300A situated outside the supply wells 200 and configured to connect said pump 2000 to said diffusion well 600; at least one auxiliary cooling apparatus 2100 within the enclosure 1300 adapted to receive groundwater from the geothermal apparatus 300 and precool return air from the enclosure 1300 to heat pumps 1100; and plurality of heat pumps 1100 connected to the geothermal apparatus 300 & the auxiliary cooling apparatus 2100 to provide cooling & heating within the enclosure 1300.

In this particular embodiment, the subsurface unit 300A is communicatively coupled with a cracking pressure valve 1900 placed in the diffusion well 600. The subsurface unit 300A is configured to utilise geothermal energy of subsurface elements, such as soil or rock or such. The said alternate embodiment of the system thus utilises geothermal energy of the subsurface elements in addition to the groundwater with the help of the geothermal apparatus 300.

Figure 12A:
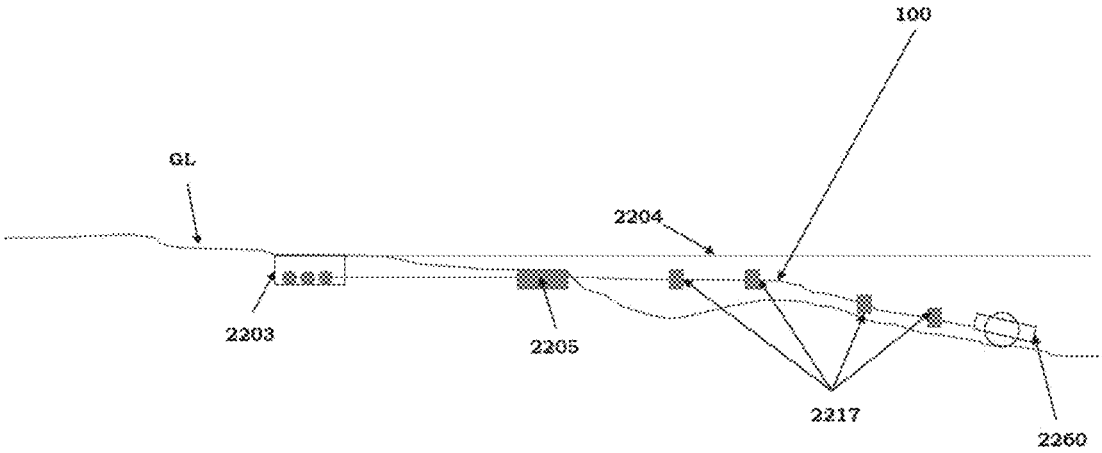
FIG. 12*a* illustrates alternative form of the advection based movable system.
Figure 12B:
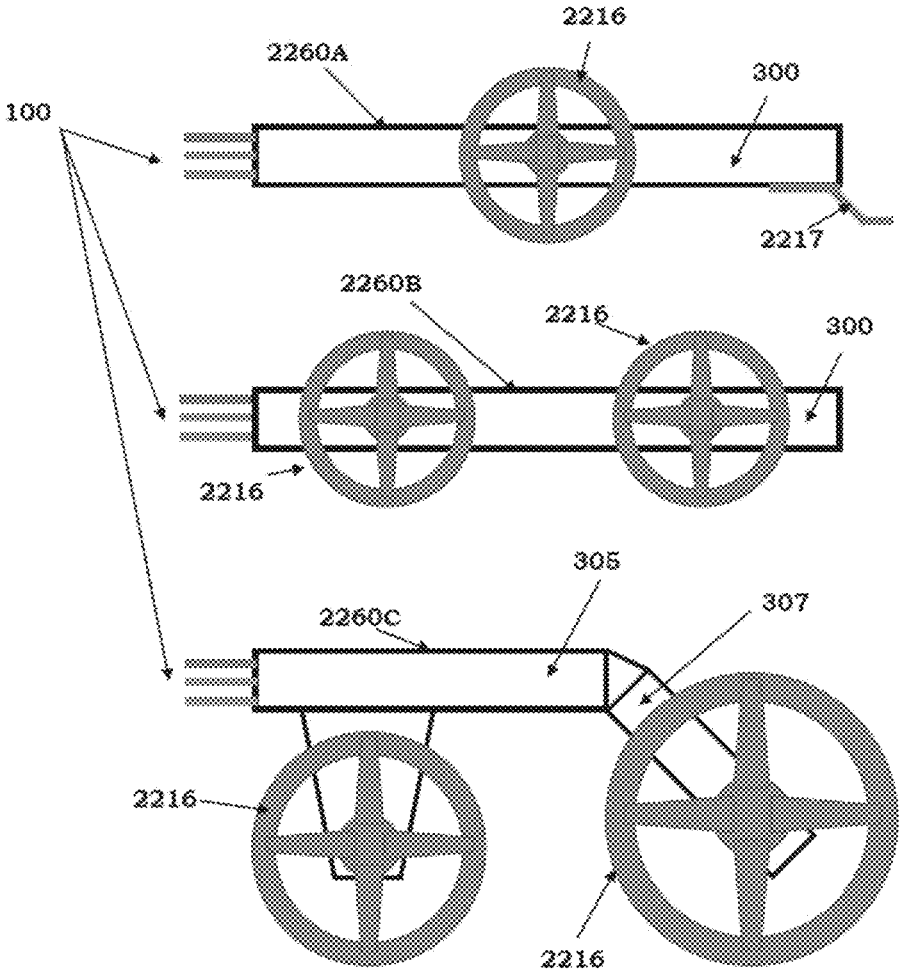
FIG. 12*b* illustrates a cannon unit 2260, which is a part of the system depicted in FIG. 12*a*.

FIG. 12*a* and FIG. 12*b* show the alternative form of the advection based geothermal system. This form is employed when the water source is a surface water body, such as a lake, a pond, a river or any such source. The said movable system comprises of a cannon unit 2260, an inline valve box 2205, and a trench bundle 2203. The cannon unit 2260 is submerged in surface water bodies 2204 and is connected with the pipes buried in the trench 2203 via a set of three flexible pipes 100. The flexible pipes 100 are analogous to a set of the pipes 100 depicted in FIG. 1. The pump cables are connected by binding clips 2217. The cannon unit 2260 is connected to a puller sling 254 to pull the cannon unit 2260 out of the surface water body 2204.

The water from the surface water body 2204 is released back to the surface water body at one or more outfalls at least 50 feet away from the site of intake after exchanging heat. In this case, the outfalls are similar to the diffusion wells 600 depicted in FIG. 1. However in contrast to the system depicted in FIG. 1, the supply wells 200 and the diffusion well 600 are not required in the system depicted in FIG. 12, since the water is drawn from a surface water body. Similar to preferred embodiment and alternate embodiment described previously, the trench 2203 connects to the building.

The cannon unit 2260 is provided with at least one pair of wheels 2216 in various configurations illustrated in FIG. 12*b*, for the purpose of pulling or pushing the cannon unit 2260 from or into a surface water body 2204. The pipe bundle is connected to a valve box 2205 along the shoreline, which is usually located outside the water body.

Figure 12C:
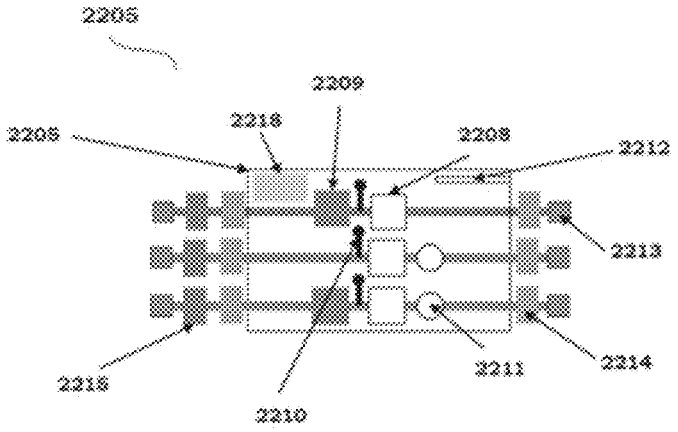
FIG. 12*c* illustrates a valve box 2205 of the system depicted in FIG. 12*a*.

FIG. 12*c* illustrates the valve box 2205, wherein the valve box 2205 is a semi-hermetic box with gaskets to keep water away from internal components. The valve box 2205 is provided with a barb fittings 2213, at least one union joint 2214, at least one expander fitting 2215, a flow meter 2209, at least one temperature sensor 2210, at least one motorized isolation valve 2208, at least one antifreeze composition recovery port 2211, and a heater element and an air temperature sensor 2212. In this embodiment, the expander fitting 2215 assists in the transition from one pipe diameter to another. The union joints 2214 is adapted to decouple the cannon unit 2260 from the valve box 2205 or the trench commoner pipes 2203. The barb fittings 2213 provided on both sides of the valve box 2205 is configured to connect flexible pipes 100 to the valve box 2205. Before opening or disconnecting the valve box 2205, the motorized valves 2208 are charged from an external power source. The valve box 2205 has access 2218 for connecting to an external power supply, and a portable monitoring device that reads the flow meters' 2209 and the temperature sensors' 2210 values. The antifreeze composition recovery ports 2211 may be connected to the recovery unit 390 for glycol or comparable fluid recovery or addition to the system. Once the isolation valves 2208 are turned off, the recovery ports 2211 may be opened.

The configuration and arrangement within the system is unique vis-à-vis existing geothermal systems. The configuration of the system enhances its functioning by at least 50% compared to that of the prior art. The increased efficiency is not just for the system, but with each of the supply well also. The inventor has figured out through data that the land requirement for working of the system is at least 80% less than that of the existing systems. Reduced cost is another advantage, wherein the present system requires half of the cost for that of the existing systems.

I claim:

1. A system for controlling heat exchange for an enclosure, the system comprising:

a closed fluid loop;

at least one supply well extending below ground level and adapted to receive groundwater from a groundwater source;

at least one geothermal apparatus, wherein each geothermal apparatus of the at least one geothermal apparatus is disposed within a respective supply well of the at least one supply well, wherein each geothermal apparatus comprises:

a heat exchanger configured to receive the groundwater from the respective well of the at least one supply well and exchange heat between the groundwater from the respective well of the at least one supply well and the closed fluid loop, wherein the closed fluid loop is configured to exchange heat for circulation within the enclosure; and a groundwater pump unit that is configured to pump groundwater through the heat exchanger of the geothermal apparatus; and a groundwater fluid pathway defining a discharge outlet, wherein the groundwater fluid pathway extends from the at least one supply well to the discharge outlet, wherein an entirety of the groundwater fluid pathway is below the ground level, and the groundwater fluid pathway comprises a groundwater pipe extending between and fluidly coupling the at least one supply well and the discharge outlet.

2. The system of claim 1, wherein each geothermal apparatus of the at least one geothermal apparatus is submerged within the groundwater of the respective supply well.

3. The system of claim 1, wherein the closed fluid loop comprises at least one heat pump and/or at least one auxiliary cooling apparatus that is configured to exchange heat for circulation within the enclosure.

4. The system of claim 1, wherein the closed fluid loop comprises closed loop inlet and outlet pipes that provide fluid communication to and from each heat exchanger.

5. The system of claim 1, wherein the closed fluid loop comprises at least one heat pump and at least one auxiliary cooling apparatus, wherein the at least one auxiliary cooling apparatus is configured to precool air traveling from the enclosure to the at least one heat pump.

6. The system of claim 1, further comprising at least one pitless adapter unit, wherein a respective pitless adapter unit of the at least one pitless adapter unit is disposed in each supply well of the at least one supply well, wherein each pitless adapter unit of the at least one pitless adapter unit comprises:

a first fluid connection that is configured to direct the groundwater discharged from the heat exchanger to the discharge outlet; and second and third fluid connections providing fluid communication lines to the closed loop and from the respective heat exchanger of the supply well.

7. The system of claim 6, further comprising at least one holding device, wherein a respective holding device of the at least one holding device supports each pitless adapter of the at least one pitless adapter within a respective supply well of the at least one supply well.

8. The system of claim 7, wherein each geothermal apparatus of the at least one geothermal apparatus is coupled to a respective pitless adapter of the at least one pitless adapter so that the respective pitless adapter supports the geothermal apparatus within the respective supply well of the at least one supply well.

9. The system of claim 8, wherein each holding device of the at least one holding device comprises a respective well cap and a support that extends between and couples to the well cap and a respective pitless adapter of the at least one pitless adapter.

10. The system of claim 9, wherein the support comprises at least one pump sling holder;

a fixed sling hook;

at least one fixed sling attached to one end of the pump sling holder by the fixed sling hook;

a liftable sling hook; and at least one liftable sling attached to another end of the pump sling holder by the liftable sling hook.

11. The system of claim 1, wherein the at least one geothermal apparatus comprises a filtration unit.

12. The system of claim 11, wherein the filtration unit comprises:

a plurality of sieves and slots provided at a middle portion of the at least one geothermal apparatus;

a suction tube below said plurality of sieves and slots;

a slider cone below the suction tube;

a suction gate plate below the slider cone;

a collector below the suction gate plate; and an aperture below the collector.

13. The system of claim 1, wherein the at least one geothermal apparatus comprises a constant flow valve configured to regulate flow toward the discharge outlet.

14. The system of claim 1, wherein the at least one geothermal apparatus comprises a constant flow valve configured to regulate flow of fluid of the closed fluid loop through the heat exchanger.

15. The system of claim 1, wherein the groundwater fluid pathway comprises a cracking pressure valve that is configured to inhibit air intake into the groundwater fluid pathway.

16. The system of claim 1, further comprising a diffusion well, wherein the discharge outlet is positioned within the diffusion well.

17. The system of claim 16, wherein the diffusion well is parallel to the at least one supply well.

18. The system of claim 16, wherein the diffusion well extends lower than the at least one supply well.

19. The system of claim 1, wherein the at least one supply well comprises a plurality of supply wells.

20. The system of claim 1, wherein the heat exchanger of the at least one geothermal apparatus is submerged within the groundwater source.

* * * * *